United States Patent [19]

Hunt, III et al.

[11] Patent Number: 4,458,758

[45] Date of Patent: Jul. 10, 1984

[54] SELECTED WELL COMPLETION FOR IMPROVING VERTICAL CONFORMANCE OF STEAM DRIVE PROCESS

[75] Inventors: William C. Hunt, III, Farmers Branch, Tex.; David S. Koons, Evergreen, Colo.

[73] Assignee: Mobil Oil Corporation, New York, N.Y.

[21] Appl. No.: 355,433

[22] Filed: Mar. 8, 1982

[51] Int. Cl.[3] ..... E21B 43/24

[52] U.S. Cl. ..... 166/272; 166/245

[58] Field of Search ..... 166/268, 271, 272

[56] References Cited

U.S. PATENT DOCUMENTS

| | | | |
|---|---|---|---|
| 2,969,226 | 1/1961 | Huntington | 166/272 X |
| 3,142,336 | 7/1964 | Doscher | 166/272 |
| 3,280,909 | 10/1966 | Closmann et al. | 166/272 X |
| 3,358,759 | 12/1967 | Parker | 166/272 X |
| 3,367,419 | 2/1968 | Van Lookeren | 166/245 |
| 3,380,527 | 4/1968 | Craighead | 166/272 |
| 3,396,791 | 8/1968 | Van Meurs et al. | 166/272 |
| 3,439,742 | 4/1969 | Durie | 166/272 |
| 3,500,917 | 3/1970 | Lehner et al. | 166/272 |
| 3,838,738 | 10/1974 | Redford et al. | 166/272 X |
| 3,997,004 | 12/1976 | Wu | 166/272 X |

*Primary Examiner*—George A. Suchfield

*Attorney, Agent, or Firm*—Alexander J. McKillop; Michael G. Gilman; Charles J. Speciale

[57] ABSTRACT

The method combines the driving of oil by steam from an injection well to a production well with the overriding tendencies of the steam to give both good temperature conformance and good vertical sweep by completing the injection and production wells in limited intervals in the oil-containing formation. The injection well is completed in the bottom 20–30 percent of the vertical thickness of the oil-containing formation and the production well is completed in the bottom 40 percent of the vertical thickness of the oil-containing formation. Once the wells are completed over the limited intervals, steam is injected into the oil-containing formation at a rapid rate and fluids including oil are recovered from the formation via the production well. Injection of steam is continued until the fluid being recovered contains an unfavorable amount of steam or water. If the oil-containing formation overlies a water-saturated formation, optimum vertical conformance is obtained with the completion interval of the injection well in the bottom 20–30 percent of the vertical thickness of the oil-containing formation and the production well completed over 30–40 percent of the vertical thickness of the oil-containing formation beginning at a point above the water-saturated formation a distance of about 10 percent of the vertical thickness of the oil-containing formation.

8 Claims, 10 Drawing Figures

STEAM FLOOD PILOT CONFIGURATION 7 inverted seven spots 2.3 acre/well spacing 1 steam generator/pattern at 50MM btu/hr

SELECTED WELL COMPLETION FOR IMPROVING VERTICAL CONFORMANCE OF STEAM DRIVE PROCESS

FIELD OF THE INVENTION

The present invention relates to a steam drive process for recovering viscous oil from a subterranean, viscous oil-containing formation. More particularly, the present invention involves an improved steam drive and recovery method wherein the injection and production wells are completed in limited intervals in the oil-containing zone to improve vertical conformance of the steam drive process.

BACKGROUND OF THE INVENTION

Many oil reservoirs have been discovered which contain vast quantities of oil, but little or no oil has been recovered from many of them because the oil present in the reservoir is so viscous that is is essentially immobile at reservoir conditions, and little or no petroleum flow will occur into a well drilled into the formation even if a natural or artificially induced pressure differential exists between the formation and the well. Some form of supplemental oil recovery process must be applied to these formations which decreases the viscosity of the oil sufficiently that it will flow or can be dispersed through the formation to a production well and therethrough to the surface of the earth. Thermal recovery techniques are quite suitable for viscous oil formations, and steam flooding is the most successful thermal oil recovery technique yet employed commercially.

Steam may be utilized for thermal stimulation for viscous oil production by means of a steam drive or steam throughput process, in which steam is injected into the formation on a more or less continuous basis by means of an injection well and oil is recovered from the formation from a spaced-apart production well. While this process is very effective with respect to the portion of the recovery zone between the injection well and production well through which the steam travels, poor vertical and horizontal conformance is often experienced in steam drive oil recovery processes. By vertical conformance, it is meant the portion of the vertical thickness of a formation through which the injected steam passes. A major cause of poor vertical conformance is caused by steam, being of lower density than other fluids present in the permeable formation, migrating to the upper portion of the oil formation to the remotely located production well. Once steam channeling has occurred in the upper portion of the formation, the permeability of the steam-swept zone is increased due to the desaturation or removal of oil from the portion of the formation through which steam has channeled. Thus subsequently-injected steam will migrate almost exclusively through the steam-swept channel and very little of the injected steam will move into the lower portions of the formation, and thus very little additional oil from the lower portion of the formation will be produced. While steam drive processes effectively reduce the oil saturation in the portions of the formation through which they travel by a significant amount, a large portion of the recovery zone between the injection and production systems is not contacted by steam and so a significant amount of oil remains in the formation after completion of the steam drive oil recovery process. The severity of the poor vertical conformance problem increases with the thickness of the oil formation and with the viscosity of the oil contained in the formation.

In view of the foregoing discussion, it can be appreciated that there is a substantial, unfulfilled need for a method of conducting a well-to-well steam injection oil recovery method in a manner which results in improved vertical conformance.

SUMMARY OF THE INVENTION

The process of the present invention involves an improved steam drive oil recovery method for recovering viscous oil from a subterranean, viscous oil-containing formation having no significant vertical permeability barrier therein and penetrated by at least one injection well and at least one spaced-apart production well. The method accomplishes efficient recovery of the viscous oil from the formation with improved vertical conformance or sweep efficiency. The injection well is in fluid communication with the bottom 20–30 percent of the vertical thickness of the oil-containing formation and the production well is in fluid communication with the bottom 40 percent of the vertical thickness of the oil-containing formation. Steam is rapidly injected into the formation via the injection well and fluids including oil are recovered from the formation via the production well. Production is continued until the fluid being recovered contains an unfavorable amount of steam or water. If the viscous oil-containing formation overlies a water-saturated formation, optimum vertical conformance of the steam drive process is obtained with the injection well in fluid communication with the bottom 20–30 percent of the vertical thickness of the oil-containing formation and the production well in fluid communication with 30–40 percent of the vertical thickness of the oil-containing formation beginning at a point above the water-saturated formation a distance of about 10 percent of the vertical thickness of the oil-containing formation. The fluid communication in the injection well is preferably throughout the bottom 20–30 percent of the vertical thickness of the oil-containing formation. Similarly, the fluid-communication in the production well is preferably throughout the bottom 30–40 percent of the vertical thickness of the oil-containing formation.

DESCRIPTION OF THE PREFERRED EMBODIMENTS

Figure 1:
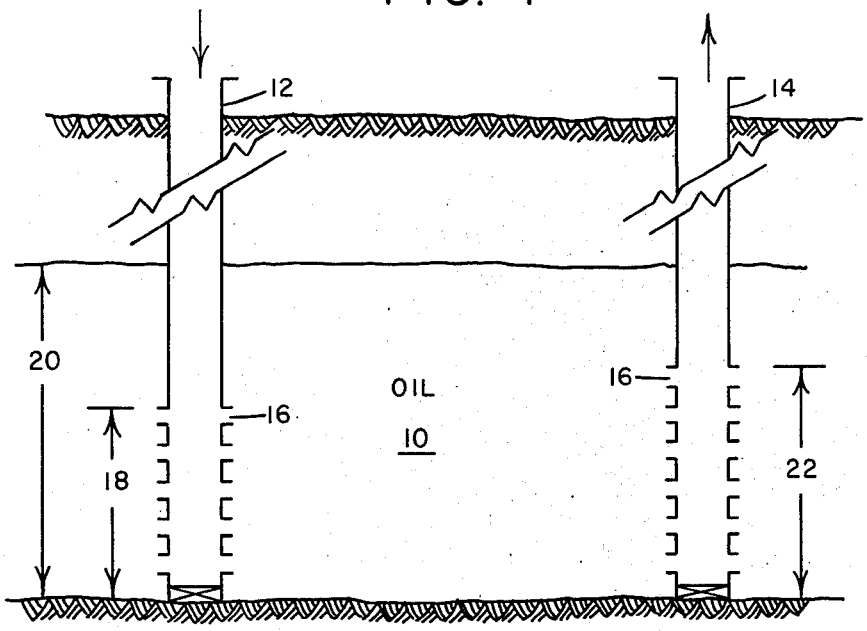
FIG. 1 illustrates in cross-section view a subterranean, viscous oil-containing formation penetrated by an injection well and a production well completed over a limited interval of the vertical thickness of the viscous oil-containing formation.
Figure 2:
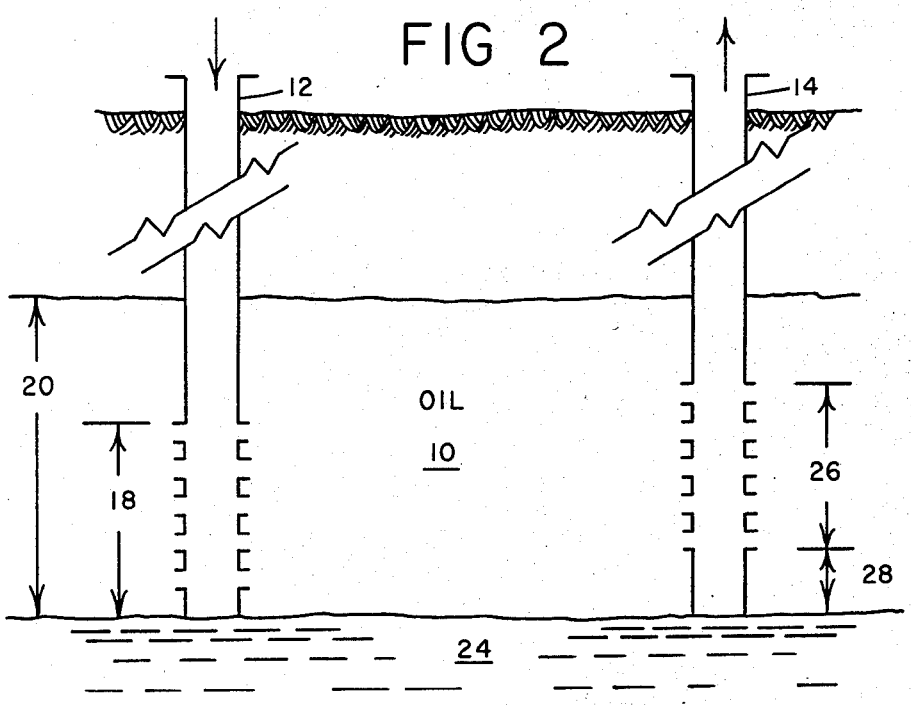
FIG. 2 illustates in cross-sectional view essentially the same subject as is shown in FIG. 1, except that the viscous oil-containing formation is overlying a water-saturated formation and the completion interval of the production well is different.

The process of our invention is better understood by referring to FIG. 1 wherein a viscous oil-containing formation 10 having no significant vertical permeability barrier therein is penetrated by an injection well 12 and a spaced-apart production well 14. Injection well 12 is in fluid communication with the oil-containing formation 10 through perforations 16 fomred in the bottom portion of the formation over a distance designated as 18 in FIG. 1 equal to from about 20 to about 30 percent of the vertical thickness 20 of the oil-containing formation and preferably 22.5 percent. The production well 14 is in fluid communication through perforations 16 with the bottom 40 percent of the vertical thickness 20 of the oil-containing formation 10 designated as 22 in FIG. 1. If the oil-containing formation 10 overlies a water-saturated formation 24 as shown in FIG. 2, the injection well is in fluid communication with the same portion of the oil-containing formation as shown in FIG. 1, however, the production well is in fluid communication with the oil-containing formation through perforations 16 formed over a distance designated as 26 in FIG. 2 equal to about 30–40 percent of the vertical thickness 20 of the oil-containing formation and preferably 30 percent beginning at a distance designated as 28 equal to about 10 percent of the vertical thickness of the oil-containing formation above the water-saturated formation.

Steam is injected into the oil-containing formation 10 via the injection well 12 at a high injection rate within the range of 1.75 to 2.35 barrels of steam (measured as liquid water) per day per acre-foot of the oil-containing formation (pay zone), and fluids including oil are recovered via production well 14. The preferred steam injection rate is 2.14 bbis/day/acre-foot (pay zone).

The quality of the steam may range from 60–90 percent. The injected steam gives up its heat to the viscous oil in the formation thereby reducing the viscosity and displaces the mobilized oil through the formation toward the production well 14, from which fluids including oil are recovered. Injection of steam is continued until the fluid recovered from production well 14 comprises an unfavorable amount of steam or water.

EXPERIMENTAL SECTION

Utilizing a reservoir simulation model and computer program we will demonstrate the technical superiority of our method.

Figure 3:
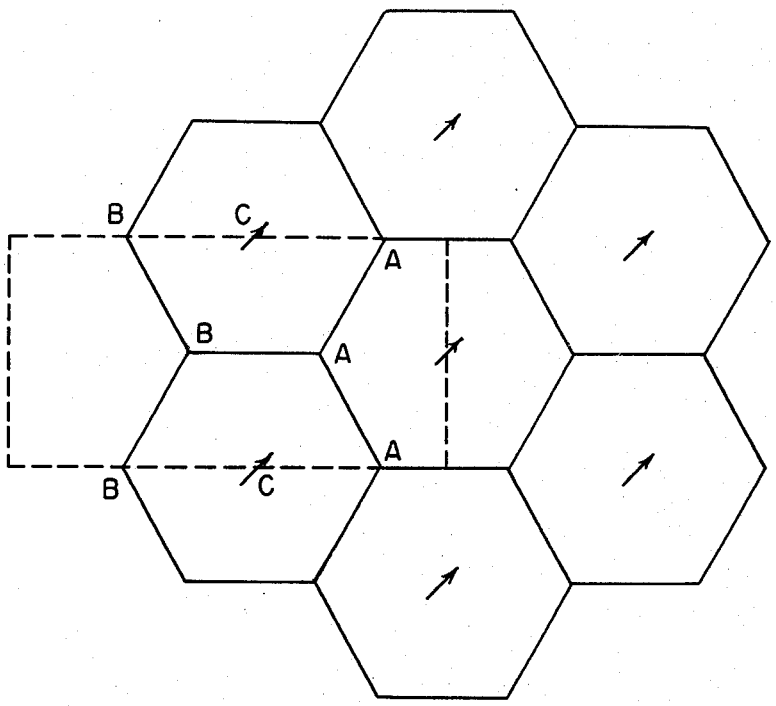
FIG. 3 illustrates the well pattern of the steam flood pilot layout used in the reservoir simulation model.
Figure 4:
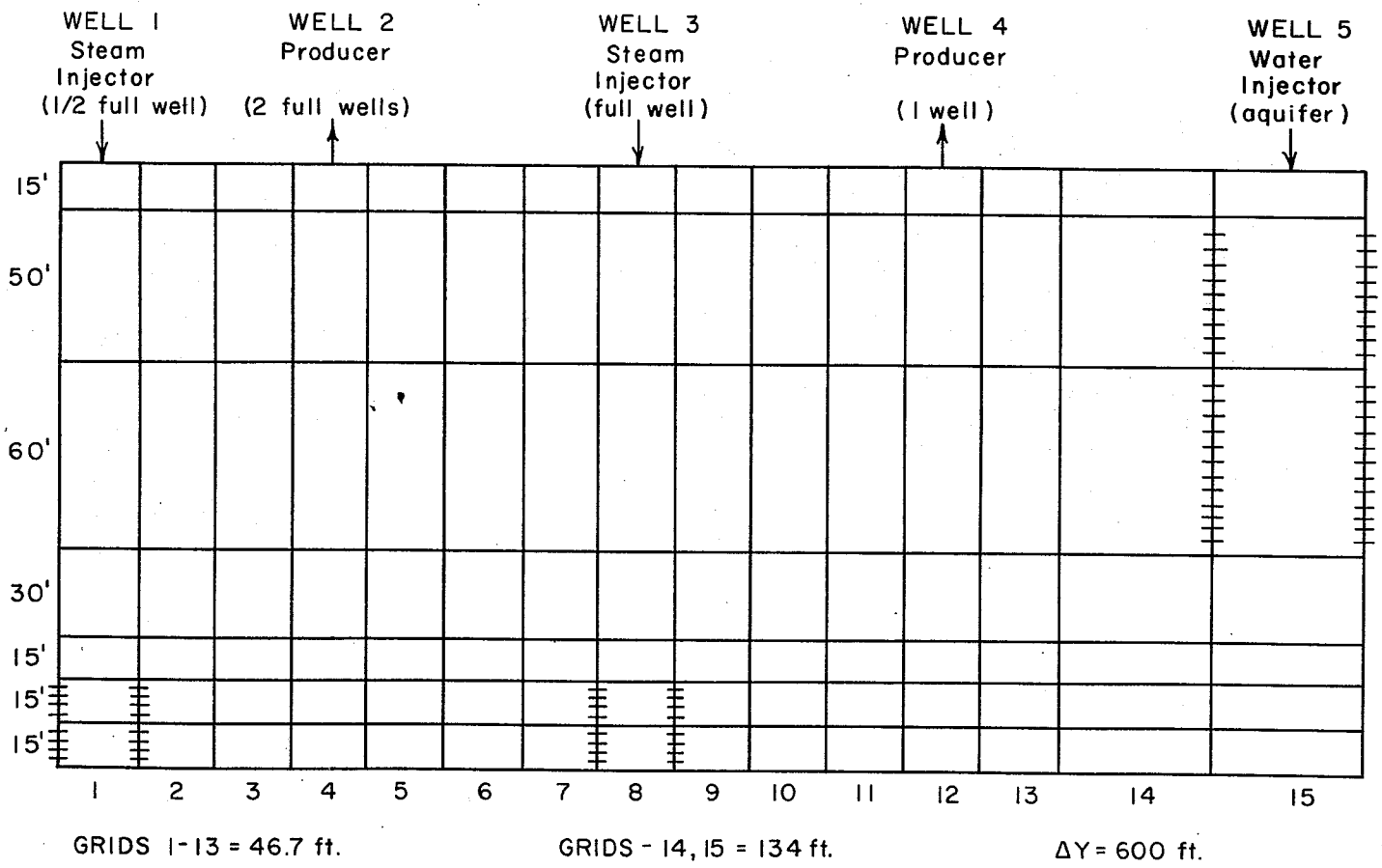
FIG. 4 illustrates the dimensions of the grid pattern of the simulated reservoir.

The model described herein was devised to simulate one-sixth of an Experimental Steam Flood Pilot. A diagram of the well pattern of the pilot lay out is shown in FIG. 3 comprising 7 inverted 7-spot patterns. In a 7-spot arrangement, a centrally located well is used as an injection well and six peripherally spaced wells are used as production wells. The simulated portion of the pilot is outlined by dotted lines. FIG. 4 shows the grid system for the simulation runs. The model consists of 15 sections in the x direction, seven layers in the z direction, and only one y grid. This is a standard cross-sectional two dimensional representation. Dimensions for the x and y grid of the model are given in FIG. 4.

Five wells were used in this version of the model. The two producers (in Grids 4B and 12B) are composites of several pilot wells. The three wells designated by an A in FIG. 3 are equivalent to two full producers, whereas the three wells designated by B are equivalent to only one full producer. A full producer is defined here as a well completely surrounded by three injectors. The two steam injectors (in Grids 1B and 8B) are also composites. The injector in Grid I is only a half injector as only half of the swept area for the pilot injector is in the simulated area. The injector in Grid 8B combines the two "half" injectors designated by C in FIG. 3 to total one full injector. A full injector is defined to be capable of injecting 3000 bbis/day (cold water equivalent) of steam. The water injection well located in Grid 15B simulates the aquifer. The injection pressure is set to 300 psia and the well shuts in above that pressure.

Table 1 below lists the basic reservoir data that were used in the simulation model.

TABLE 1

| | |
|---|---|
| Reservoir Data | |
| Formation Thickness | 200 ft. |
| API gravity of crude oil | 11.5° |
| Well spacing (7 inverted 7 spots) | 2.3 acres/well |
| Injection Data | |
| Steam Injection pressure | 450 psia |
| Steam Injection rate | 1.5 bbl/day per acre-foot of pay zone |

Figure 5:
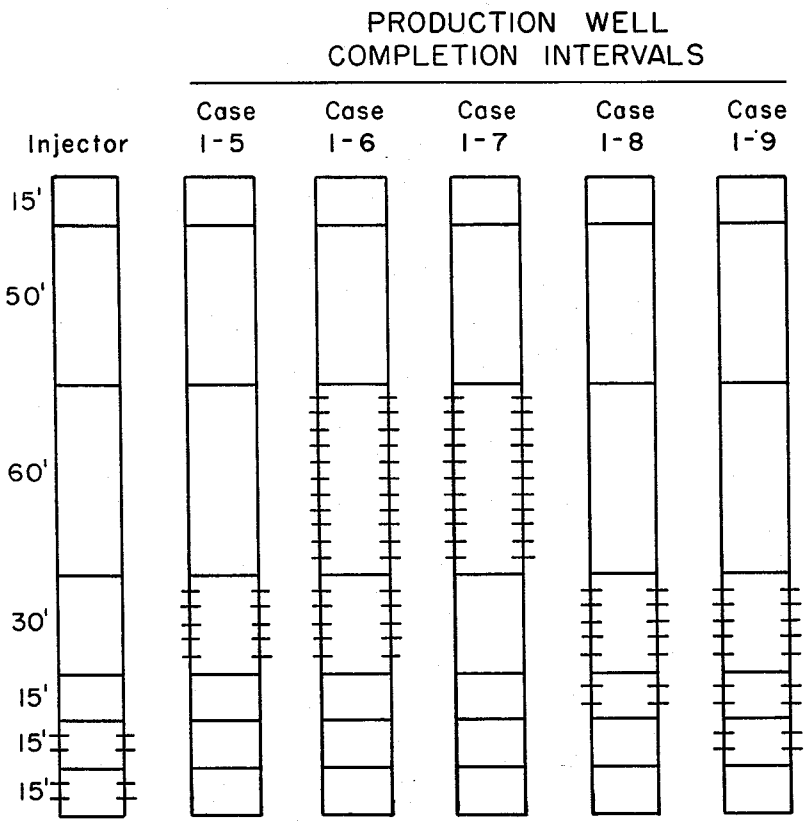
FIG. 5 illustrates the completion levels of an injection well and five different production wells used in the reservoir simulation model.

FIG. 5 shows completion levels for five different production wells designated as Case I-5, Case I-6, Case I-7, Case I-8, and Case I-9 and the completion level of one injection well which was maintained constant in the bottom 30 feet as illustrated in FIG. 5. For all runs, bottom hole pressure, steam rates and qualities, and initial conditions were held constant. Steam injection was continued until there was a steam breakthrough at the production well.

Figure 6:
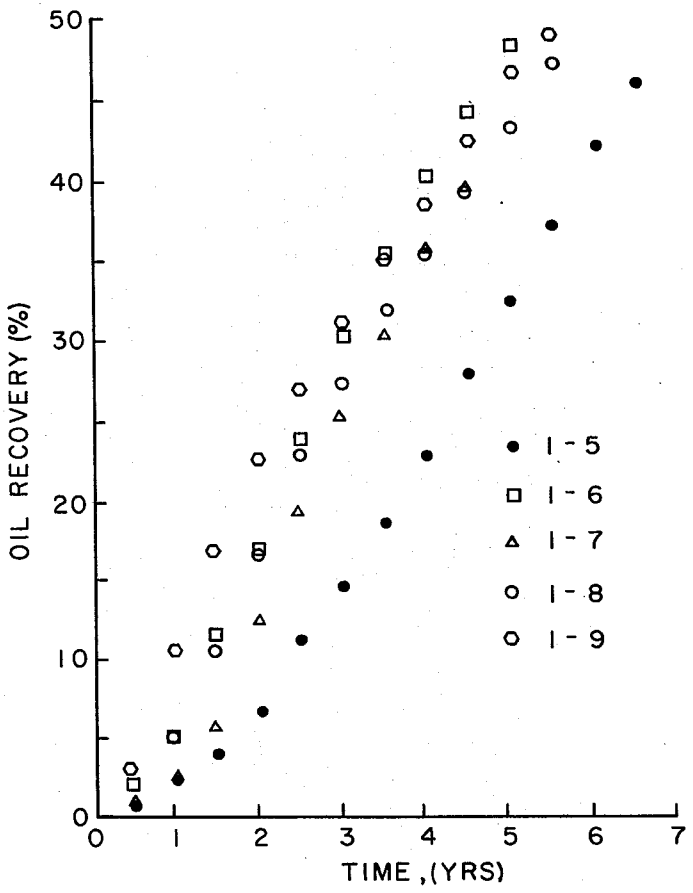
FIG. 6 is a graph showing the amount of oil recovery (percent) versus time in years for the well completion intervals shown in FIG. 5.
Figure 7:
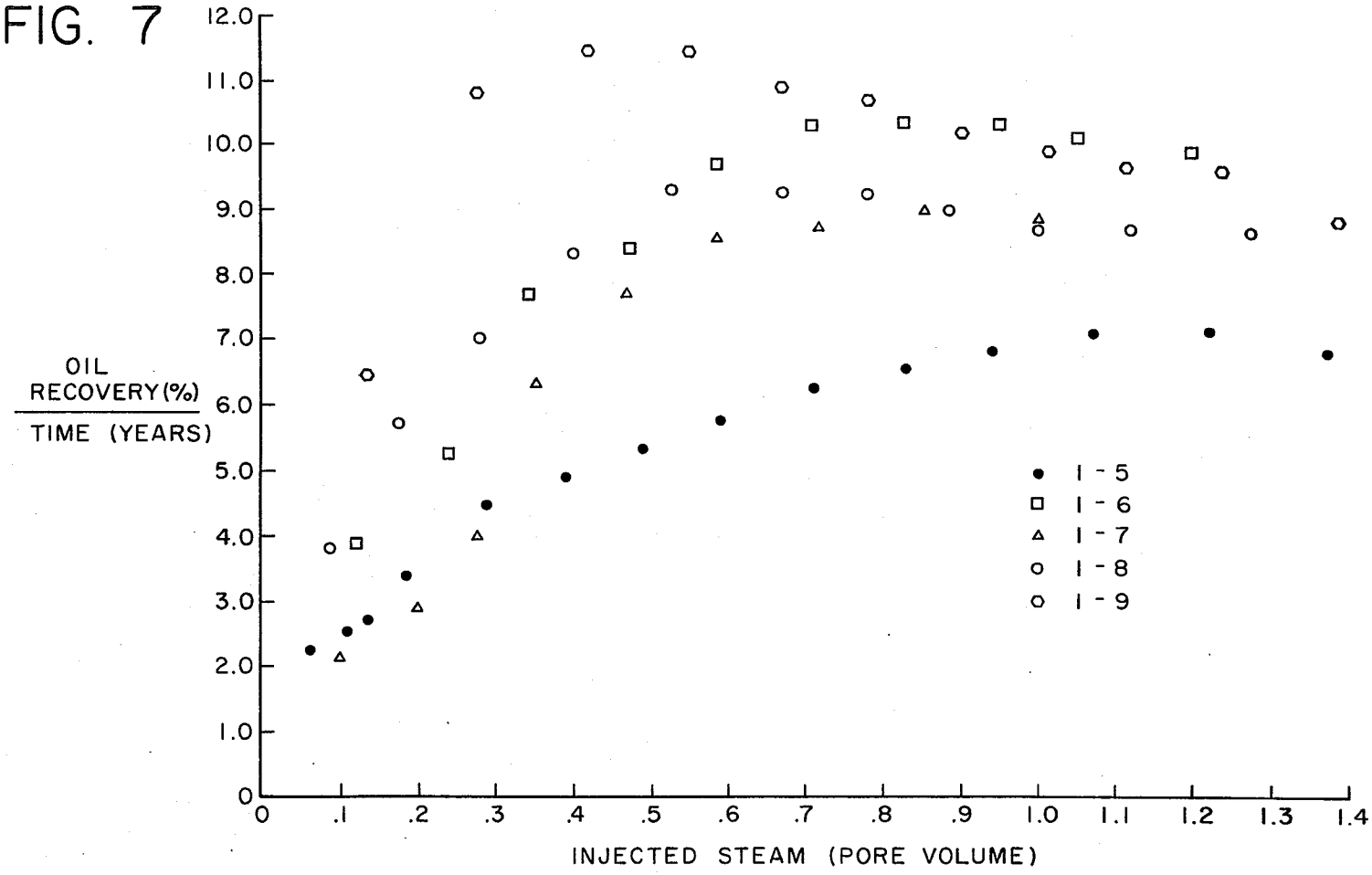
FIG. 7 is a graph showing the amount of oil recovery (percent) per time in years versus pore volume of steam injected for the well completion intervals shown in FIG. 5.

Results of the five runs are best displayed by the graphical representation of FIGS. 6 and 7. FIG. 6 shows the relationship between the oil recovery and time. Oil recovery is based on the amount of oilin-place in the first 12 grids. FIG. 7 shows a plot of the cumulative oil recovery rate expressed as percent recovery divided by time in years versus the pore volume of steam injected for each run. The results shown in FIG. 7 best illustrate how quickly a particular completion interval will respond to steam injection. This rate is important because in general, the more quickly the oil is recovered, the more favorable the economics will be. This is due to time value of money considerations with respect to recovery of high front-end capital cost efforts such as steam flooding projects and the result of the shorter time for heat to be lost to the formations above and below the oil-containing formation.

FIG. 6 shows that the highest oil recovery is obtained for Case I-9 with a 49.1 percent recovery at the time of breakthrough of steam. In Case I-9, the production wells were completed in the bottom 60 feet with the bottom of the interval located 15 feet above the water zone. This completion interval represents 30 percent of the vertical thickness of the oil-containing formation beginning at a distance of 7.5 percent of the formation thickness above the water zone.

FIG. 7 also clearly shows that the highest initial recovery rate is for the Case I-9 production well completion level.

Therefore, the production well completion level of 60 feet just above the water zone and an injection well completion in the lower portion of the formation yielded the highest initial recovery rates, and the best final oil recovery as well as an evenly heated reservoir. Steam override was limited and overall sweep of the zone was fairly homogenous.

To further establish the optimum combination of injection and production well completions, additional runs were made using injection wells completed over different levels while maintaining the production well completion interval constant over 60 feet of the pay with the bottom of the interval located just above the wet zone (15 feet off bottom) while leaving all other operational variables the same. This production well completion level (Case I-9) described above yielded the best overall results. The different injection well completion intervals used along with the production well interval are shown in FIG. 8.

Figure 8:
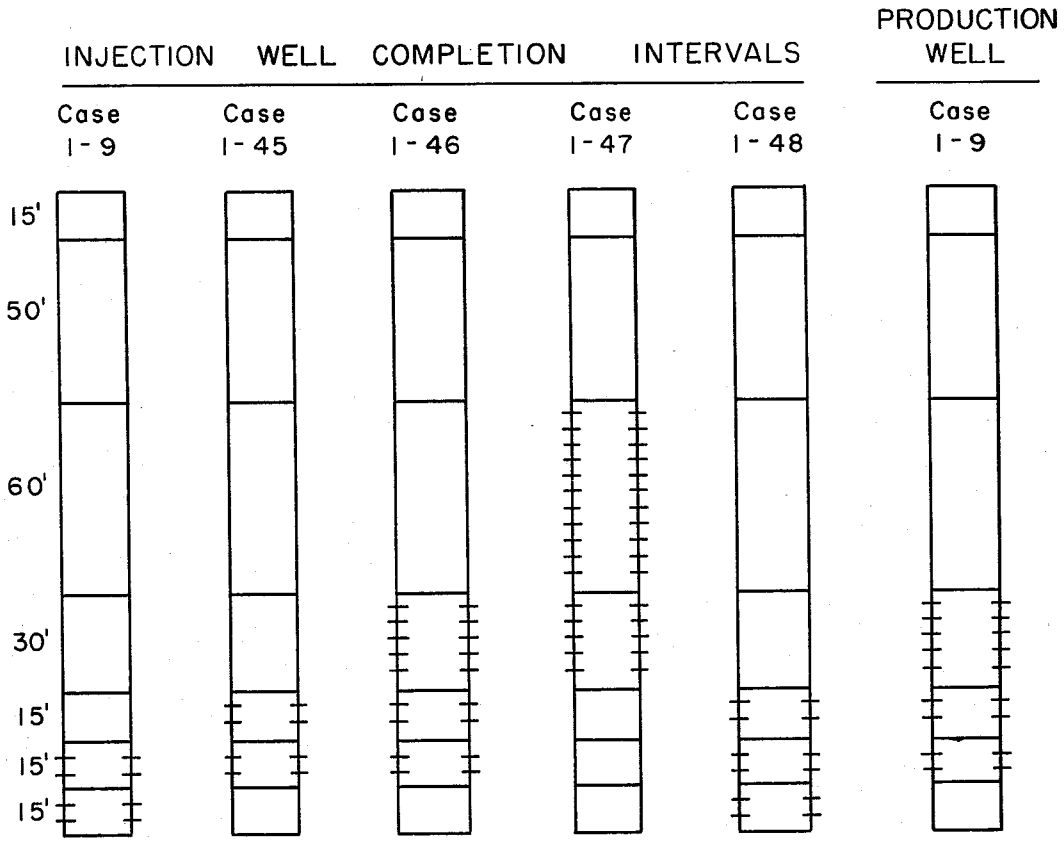
FIG. 8 illustrates the completion levels of five different injection wells and a single production well used in the reservoir simulation model.
Figure 9:
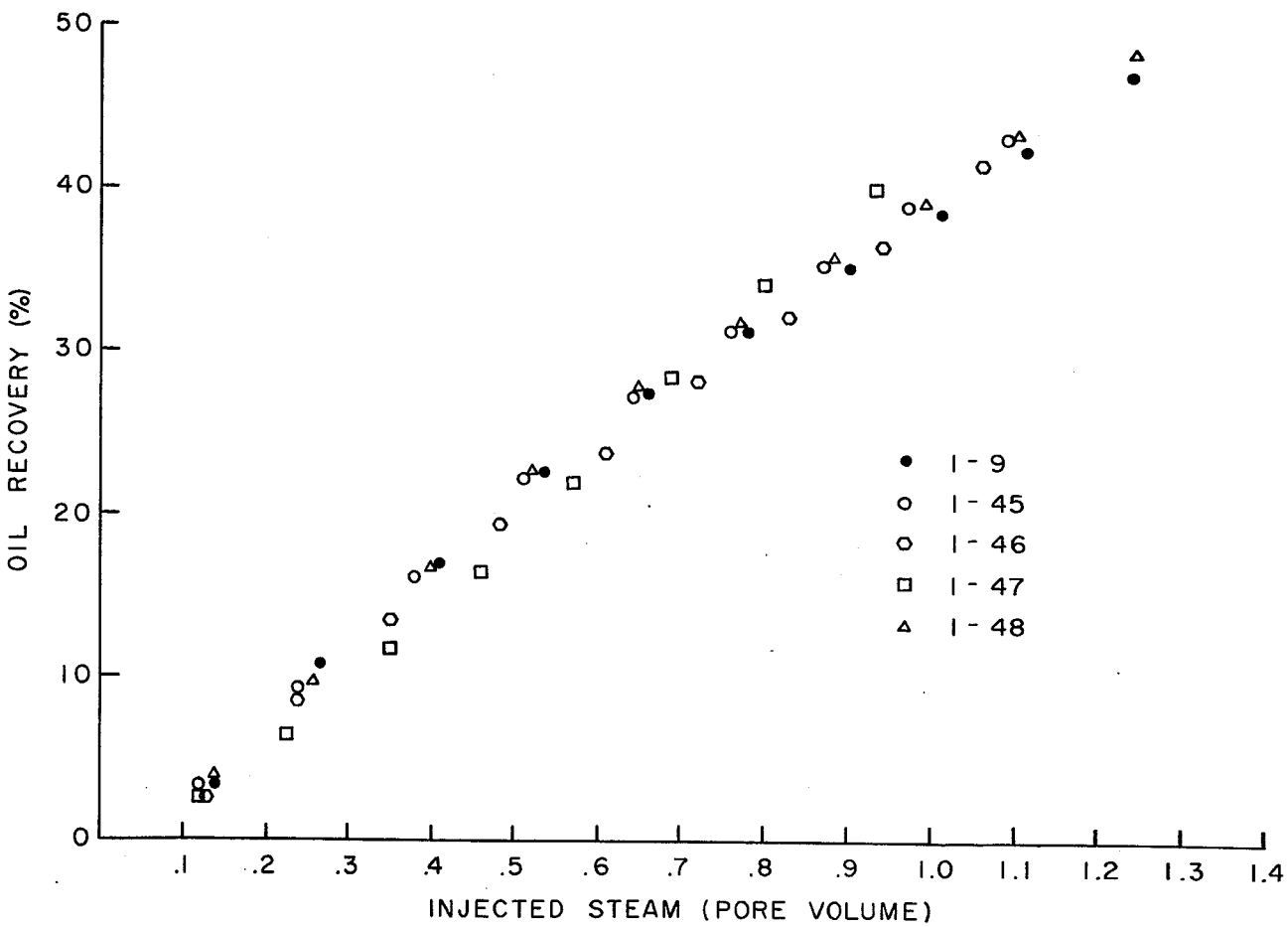
FIG. 9 is a graph showing the amount of oil recovery (percent) versus pore volume of steam injected for the well completion intervals shown in FIG. 8.
Figure 10:
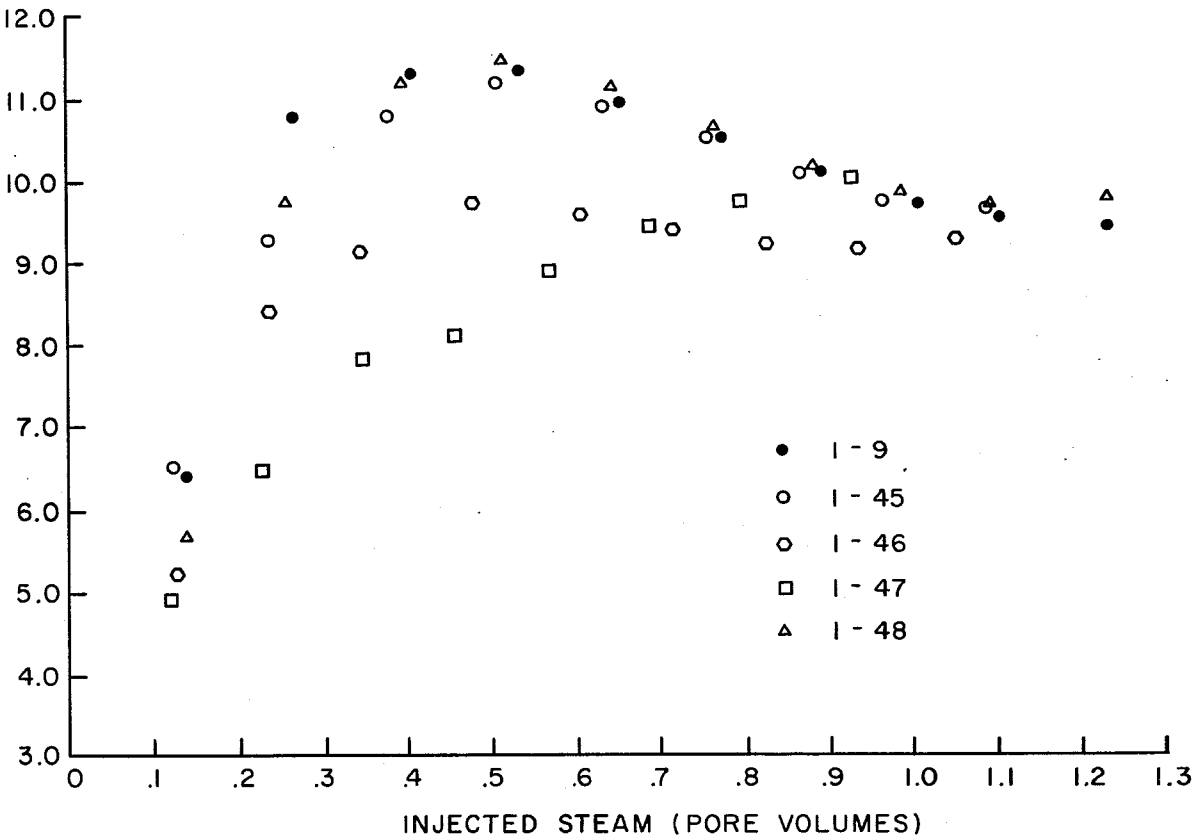
FIG. 10 is a graph showing the amount of oil recovery (percent) per time in years versus pore volume of steam injected for the well completion intervals shown in FIG. 8.

FIGS. 9 and 10 show the oil recovery (percent) and the oil recovery rate (% recovery per unit time in years) respectively versus pore volume of injected steam for the well completion intervals shown in FIG. 8.

The runs for Cases I-9, I-45, and I-48 have the highest recovery and the highest initial rate of recovery and are remarkably similar to each other in both response and recovery. Case I-9 had a slightly higher initial recovery rate but I-48 surpasses it quickly and remains higher until breakthrough.

These results show that when the production wells are completed low, the injection well must be completed low to avoid serious steam overrides and lost production. The optimum combination of injection and production well completion is to complete the injectors in the bottom 45 feet of the zone and the producers in the bottom 60 feet with the bottom of the interval located just above the water zone.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn et al.

From the foregoing specifications one skilled in the art can readily ascertain the essential features of this invention and without departing from the spirit and scope thereof can adapt it to various diverse applications. It is our intention and desire that our invention be limited only by those restrictions or limitations as are contained in the claims appended immediately hereinafter below.

What is claimed is:

1. A method for recovering viscous oil from an unfractured subterranean, viscous oil-containing formation penetrated by at least one injection well and at least one spaced-apart production well, said oil-consisting formation overlying and in contact with a water-saturated formation and having no significant vertical permeability barrier therein, comprising:

(a) establishing fluid communication between the injection well and the bottom 20–30 percent of the vertical thickness of the oil-containing formation, said communication being throughout the bottom 20–30 percent of the vertical thickness of the oil-containing formation;

(b) establishing fluid communication between the production well and the bottom 30–40 percent of the vertical thickness of the oil-containing formation beginning above the water-saturated formation at a point a distance of about 10 percent of the vertical thickness of the oil-containing formation, said communication being throughout the bottom 30–40 percent of the vertical thickness of the oil-containing formation;

(c) rapidly injecting steam into the bottom portion of the oil-containing formation via the injection well to reduce the viscosity of the oil and drive the oil toward the production well; and (d) recovering fluids including oil from the oil-containing formation via the production well.

2. The method of claim 1 wherein the steam is injected at a rate within the range of 1.75 to 2.35 barrels of steam, measured as water, per day per acre-foot of the oil-containing formation.

3. The method of claim 1 wherein the steam is injected at a rate of 2.14 barrels of steam, measured as water, per day per acre-foot of oil-containing formation.

4. The method of claim 1 wherein the injection well is in fluid communication with the formation over a distance of the bottom 22.5 percent of the vertical thickness of the oil-containing formation and the production well is in fluid communication over a distance of 30 percent of the vertical thickness of the oil-containing formation beginning above the water-saturated formation at a point a distance of about 10 percent of the vertical thickness of the oil-containing formation.

5. A method for recovering viscous oil from an unfractured subterranean, viscous oil-containing formation having no significant vertical permeability barrier therein and penetrated by at least one injection well and at least one spaced-apart production, comprising:

(a) establishing fluid communication between the injection well and the bottom 20–30 percent of the oil-containing formation, said communication being throughout the bottom 20–30 percent of the vertical thickness of the oil-containing formation;

(b) establishing fluid communication between the production well and the bottom 40 percent of the vertical thickness of the oil-containing formation, said communication being throughout the bottom 40 percent of the vertical thickness of the oil-containing formation;

(c) rapidly injecting steam into the bottom portion of the oil-containing formation via the injection well to reduce the viscosity of the oil and drive the oil toward the production well; and (d) recovering fluids including oil from the oil-containing formation via the production well.

6. The method of claim 5 wherein the steam is injected at a rate within the range of 1.75 to 2.35 barrels of steam, measured as water, per day per acre-foot of the oil-containing formation.

7. The method of claim 5 wherein the steam is injected at a rate of 2.14 barrels of steam, measured as water, per day per acre-foot of the oil-containing formation.

8. The method of claim 5 wherein the injection well is in fluid communication with the formation over a distance of 22.5 percent of the vertical thickness of the oil-containing formation.

* * * * *